US006413141B1

(12) United States Patent
Putney

(10) Patent No.: US 6,413,141 B1
(45) Date of Patent: Jul. 2, 2002

(54) NOISE ACTIVATED MOBILE

(76) Inventor: Sharon M. Putney, 22600 State Rte. #739, Raymond, OH (US) 43067

( * ) Notice: Subject to any disclaimer, the term of this patent is extended or adjusted under 35 U.S.C. 154(b) by 0 days.

(21) Appl. No.: 09/636,606

(22) Filed: Aug. 11, 2000

(51) Int. Cl.[7] ..... A63H 33/00
(52) U.S. Cl. ..... 446/227; 446/236; 446/242
(58) Field of Search ..... 446/227, 228, 446/229, 236, 242; 403/326, 327, 329; 5/93.1, 97, 503.1

(56) References Cited

U.S. PATENT DOCUMENTS 3,927,482 A * 12/1975 Marcus ..... 446/227
4,207,696 A 6/1980 Hyman et al.
4,573,654 A * 3/1986 Nottingham ..... 446/227
4,640,034 A * 2/1987 Zisholtz ..... 5/658
4,869,701 A * 9/1989 Kawai et al. ..... 446/91
4,880,197 A * 11/1989 Wsyzynski ..... 446/227
5,029,047 A 7/1991 Kachel
D323,192 S 1/1992 Takahashi et al.
5,352,145 A 10/1994 Raiffe et al.
5,672,088 A * 9/1997 Chininis ..... 446/227
5,803,786 A * 9/1998 McCormick ..... 446/227
5,848,855 A * 12/1998 Roossien ..... 403/329
6,113,455 A * 9/2000 Whelan et al. ..... 446/227
6,196,756 B1 * 3/2001 Leverger ..... 403/326

* cited by examiner

*Primary Examiner*—Jacob K. Ackun
*Assistant Examiner*—Faye Francis

(57) ABSTRACT

A noise activated mobile for soothing an infant by turning the mobile on when the infant makes a relatively loud noise. The noise activated mobile includes a housing having a lumen therein. An arm portion is elongate and has a first end and second end. The first end is securely attached to the housing. The arm extends upwardly away from the housing and is arced. A casing is integrally coupled to the second end of the arm portion. The bottom side of the casing has a hole therethrough. A motor is mounted in the casing. A rod is securely attached to the motor and extends through the hole in the casing. The motor is adapted to rotate the rod. A mobile is coupled to a free end of the rod. Control circuitry is fixedly mounted in the housing. The control circuitry is adapted for tracking elapsing time, actuating the motor and sensing relatively loud sounds. The control circuitry is operationally coupled to the motor. The control circuitry turns the motor on for a specified amount of time when a loud sound is detected. A power supply is removably mounted in the housing and is operationally coupled to the control circuitry. A coupling means couples the housing to a crib.

5 Claims, 4 Drawing Sheets

NOISE ACTIVATED MOBILE

BACKGROUND OF THE INVENTION

1. Field of the Invention

The present invention relates to mobiles and more particularly pertains to a new noise activated mobile for soothing an infant by turning the mobile on when the infant makes a relatively loud noise.

2. Description of the Prior Art

The use of mobiles is known in the prior art. More specifically, mobiles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,207,696; U.S. Pat. No. 5,803,786; U.S. Pat. No. 5,029,047; U.S. Pat. No. 5,352,145; U.S. Des. Pat. No. 323,192; and U.S. Pat. No. 4,640,034.

While these devices fulfill their respective, particular objectives and requirements, the aforementioned patents do not disclose a new noise activated mobile. The inventive device includes a housing having a lumen therein. An arm portion is elongate and has a first end and second end. The first end is securely attached to the housing. The arm extends upwardly away from the housing and is arced. A casing is integrally coupled to the second end of the arm portion. The bottom side of the casing has a hole therethrough. A motor is mounted in the casing. A rod is securely attached to the motor and extends through the hole in the casing. The motor is adapted to rotate the rod. A mobile is coupled to a free end of the rod. Control circuitry is fixedly mounted in the housing. The control circuitry is adapted for tracking elapsing time, actuating the motor and sensing relatively loud sounds. The control circuitry is operationally coupled to the motor. The control circuitry turns the motor on for a specified amount of time when a loud sound is detected. A power supply is removably mounted in the housing and is operationally coupled to the control circuitry. A coupling means couples the housing to a crib.

In these respects, the noise activated mobile according to the present invention substantially departs from the conventional concepts and designs of the prior art, and in so doing provides an apparatus primarily developed for the purpose of soothing an infant by turning the mobile on when the infant makes a relatively loud noise.

SUMMARY OF THE INVENTION

In view of the foregoing disadvantages inherent in the known types of mobiles now present in the prior art, the present invention provides a new noise activated mobile construction wherein the same can be utilized for soothing an infant by turning the. mobile on when the infant makes a relatively loud noise.

The general purpose of the present invention, which will be described subsequently in greater detail, is to provide a new noise activated mobile apparatus and method which has many of the advantages of the mobiles mentioned heretofore and many novel features that result in a new noise activated mobile which is not anticipated, rendered obvious, suggested, or even implied by any of the prior art mobiles, either alone or in any combination thereof.

To attain this, the present invention generally comprises a housing having a lumen therein. An arm portion is elongate and has a first end and second end. The first end is securely attached to the housing. The arm extends upwardly away from the housing and is arced. A casing is integrally coupled to the second end of the arm portion. The bottom side of the casing has a hole therethrough. A motor is mounted in the casing. A rod is securely attached to the motor and extends through the hole in the casing. The motor is adapted to rotate the rod. A mobile is coupled to a free end of the rod. Control circuitry is fixedly mounted in the housing. The control circuitry is adapted for tracking elapsing time, actuating the motor and sensing relatively loud sounds. The control circuitry. is operationally coupled to the motor. The control circuitry turns the motor on for a specified amount of time when a loud, sound is detected. A power supply is removably mounted in the housing and is operationally coupled to the control circuitry. A coupling means couples the housing to a crib.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new noise activated mobile apparatus and method which has many of the advantages of the mobiles mentioned heretofore and many novel features that result in a new noise activated mobile which is not anticipated, rendered obvious, suggested, or even implied by any of the prior art mobiles, either alone or in any combination thereof.

It is another object of the present invention to provide a new noise activated mobile which may be easily and efficiently manufactured and marketed.

It is a further object of the present invention to provide a new noise activated mobile which is of a durable and reliable construction.

An even further object of the present invention is to provide a new noise activated mobile which is susceptible of a low cost of manufacture with regard to both materials and labor, and which accordingly is then susceptible of low prices of sale to the consuming public, thereby making such noise activated mobile economically available to the buying public.

Still yet another object of the present invention is to provide a new noise activated mobile which provides in the apparatuses and methods of the prior art some of the advantages thereof, while simultaneously overcoming some of the disadvantages normally associated therewith.

Still another object of the present invention is to provide a new noise activated mobile for soothing an infant by turning the mobile on when the infant makes a relatively loud noise.

Yet another object of the present invention is to provide a new noise activated mobile which includes a housing having a lumen therein. An arm portion is elongate and has a first end and second end. The first end is securely attached to the housing. The arm extends upwardly away from the housing and is arced. A casing is integrally coupled to the second end of the arm portion. The bottom side of the casing has a hole therethrough. A motor is mounted in the casing. A rod is securely attached to the motor and extends through the hole in the casing. The motor is adapted to rotate the rod. A mobile is coupled to a free end of the rod. Control circuitry is fixedly mounted in the housing. The control circuitry is adapted for tracking elapsing time, actuating the motor and sensing relatively loud sounds. The control circuitry is operationally coupled to the motor. The control circuitry turns the motor on for a specified amount of time when a loud sound is detected. A power supply is removably mounted in the housing and is operationally coupled to the control circuitry. A coupling means couples the housing to a crib.

Still yet another object of the present invention is to provide a new noise activated mobile that is activated by noise such as a baby crying so that a parent need not activate the mobile.

Even still another object of the present invention is to provide a new noise activated mobile that is battery powered so that the user need not wind up the device as is often found in conventional mobiles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
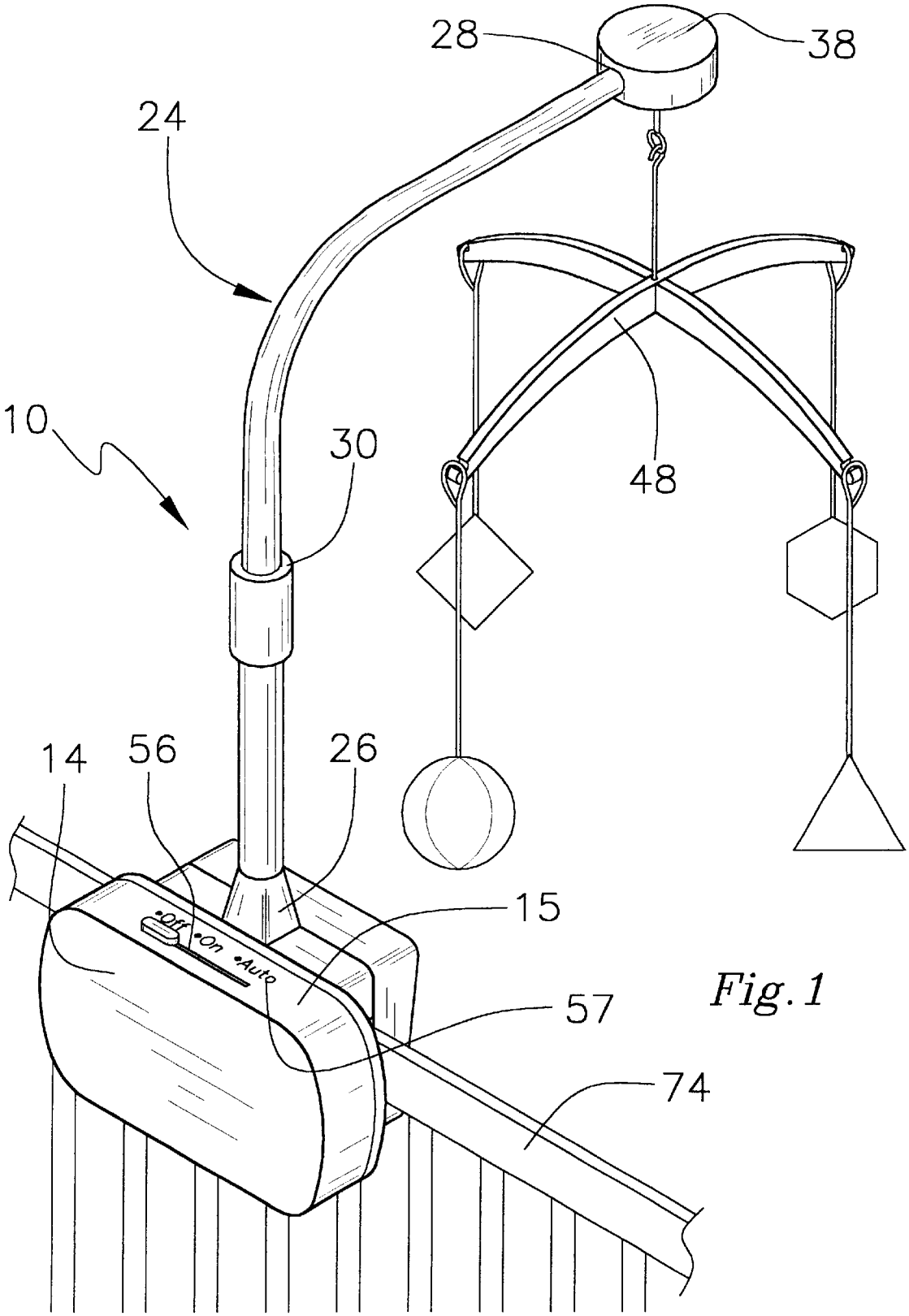
FIG. 1 is a schematic perspective view of a new noise activated mobile according to the present invention.
Figure 2:
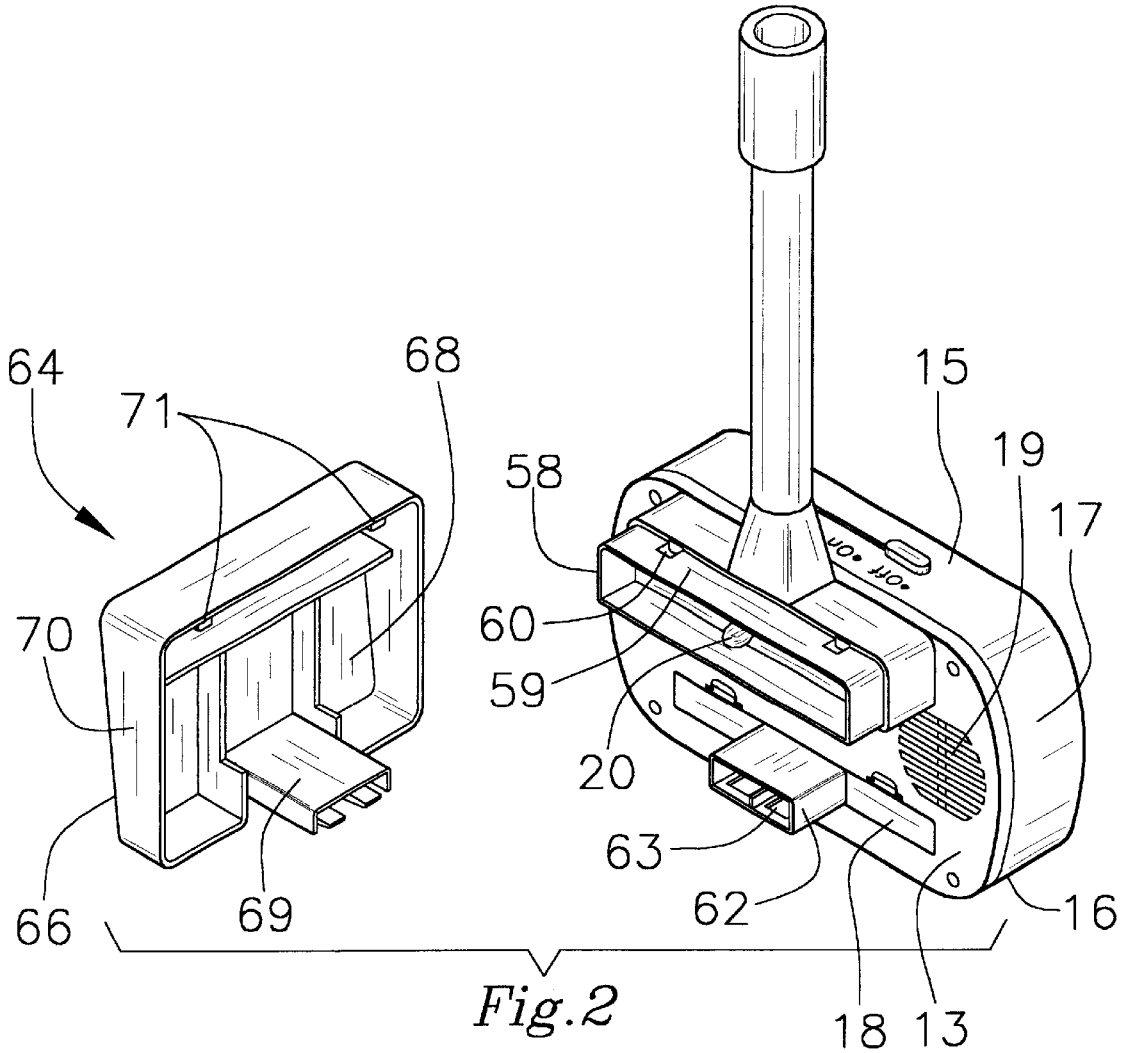
FIG. 2 is a schematic perspective view of the present invention.
Figure 3:
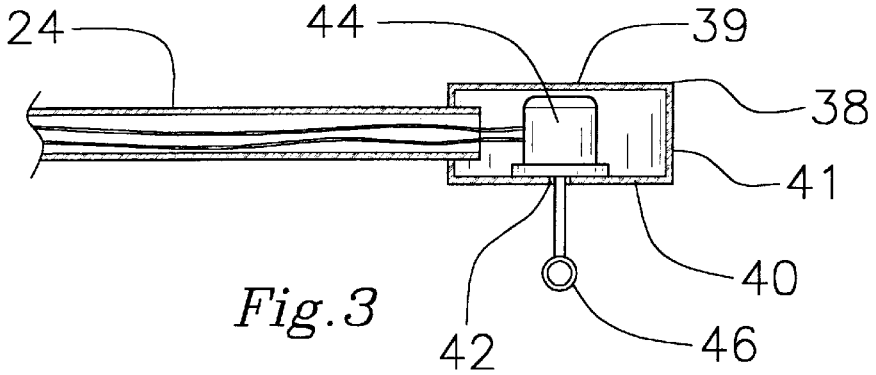
FIG. 3 is a schematic side cross-sectional view of the second portion of the arm and casing of the present invention.
Figure 4:
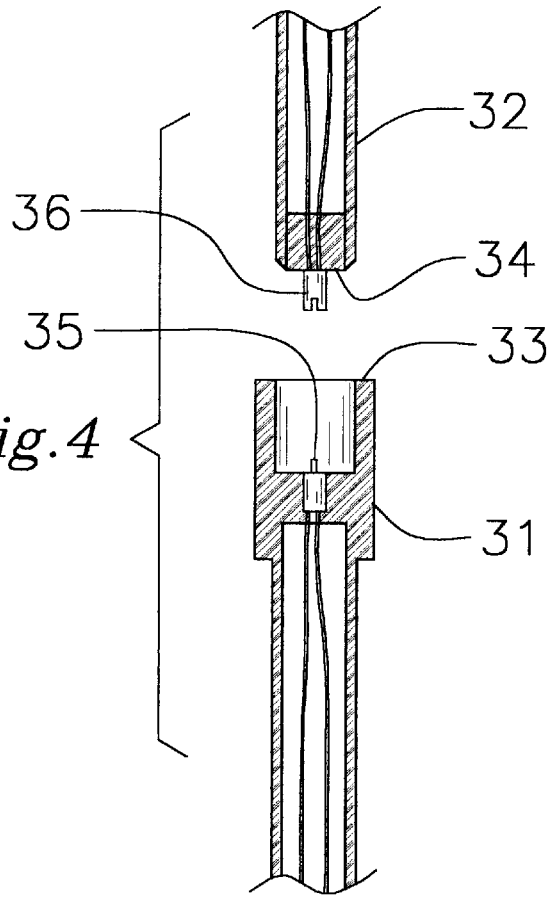
FIG. 4 is a schematic side cross-sectional view of the first portion of the arm of the present invention.
Figure 5:
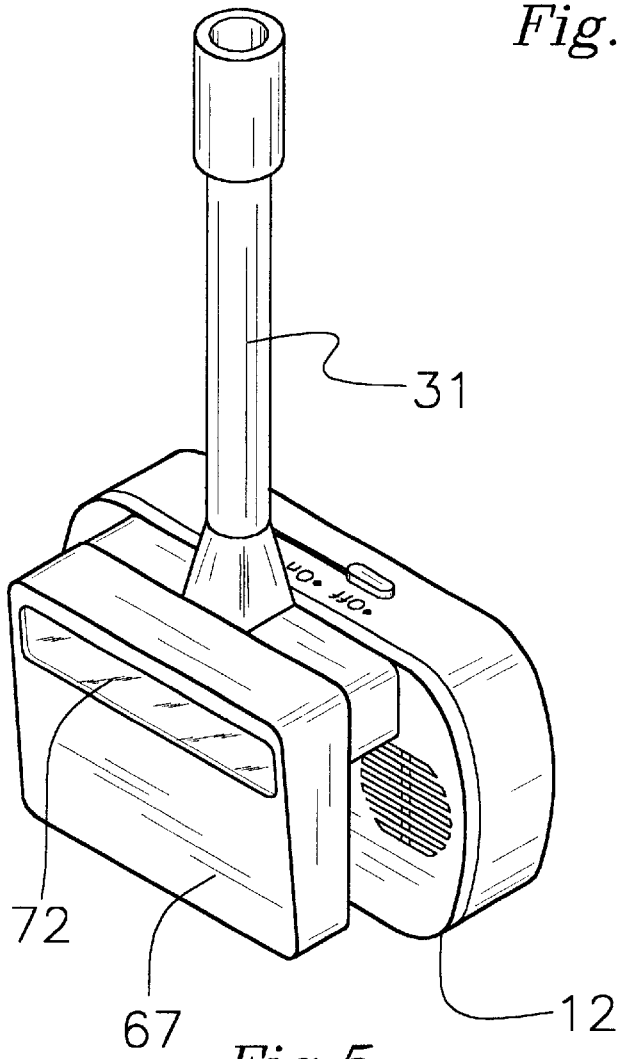
FIG. 5 is a schematic perspective view of the present invention.
Figure 6:
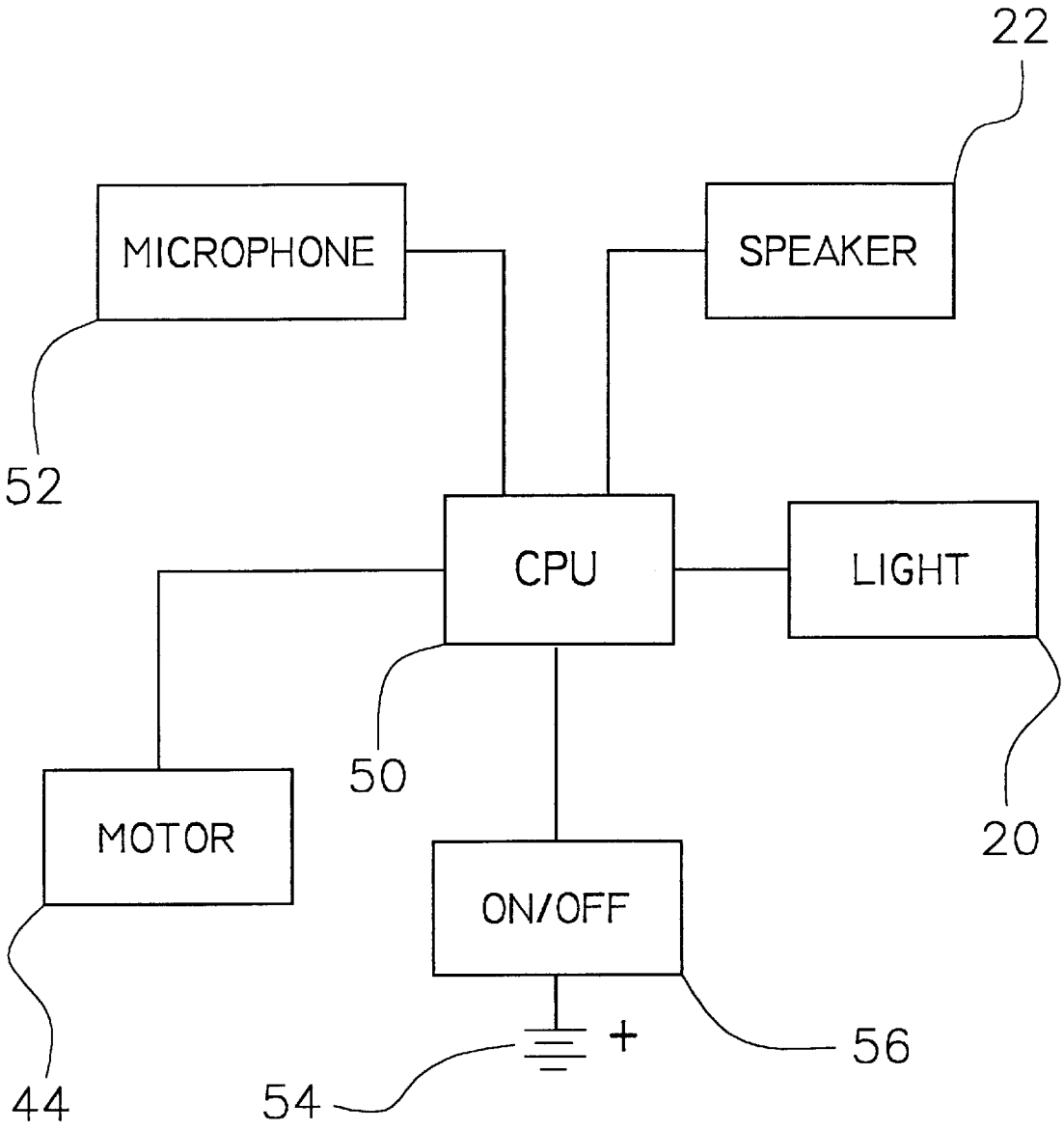
FIG. 6 is an electronic schematic view of the present invention.

With reference now to the drawings, and in particular to FIGS. 1 through 6 thereof, a new noise activated mobile embodying the principles and concepts of the present invention and generally designated by the reference numeral 10 will be described.

As best illustrated in FIGS. 1 through 6, the noise activated mobile 10 generally comprises a housing 12. The housing 12 has a back wall 13, a front wall 14, a top wall 15, a bottom wall 16 and a pair of side walls 17. The housing 12 has a lumen therein, not shown. The back wall 13 has a door 18 therein. The door 18 is selectively removable from the back wall 13. The back wall 13 has a plurality of apertures 19 therein positioned generally adjacent to one of the side walls 17.

A light emitting means 20 for emitting a light is mounted on the back wall 13. The light emitting means 20 preferably comprises a light bulb.

A speaker 22 adapted for emitting sound is securely mounted in the lumen and positioned generally adjacent to the apertures 19 in the back wall 13, such that sound emitted by the speaker 22 may travel through the apertures 19.

An arm portion 24 is elongate and has a first end 26 and second end 28. The first end 26 is securely attached to the housing 12. The arm 24 extends upwardly away from the housing 12. The arm 24 is arced and has break 30 therein such that a first portion 31 and second portion 32 is defined. The break 30 is generally nearer the first end 26 than the second end 28 of the arm portion 24. The first portion 31 is removably coupled to the second portion 32 such that an end 34 of the second portion 32 is extendable into an end 33 of the first portion 31. The end 34 of the second portion has a male plug 36 attached thereto. The end 33 of the first portion has a female plug 35 attached thereto. When the second portion 32 is inserted into the first portion 31, the male plug 36 operationally couples to the female plug 35.

A casing 38 has a top side 39, a bottom side 40 and a peripheral wall 41 extending therebetween. The peripheral wall 41 of the casing 38 is integrally coupled to the second end 28 of the arm portion 24. The bottom side 40 has a hole 42 therethrough.

A motor 44 is mounted in the casing 38. A rod 46 is securely attached to the motor 44 and extends through the hole 42 in the casing 38. The motor 44 is adapted to rotate the rod 46. The motor 44 is operationally coupled to the male plug 36. A conventional mobile 48 is removably coupled to a free end of the rod 46. The motor is an electric motor.

Control circuitry 50, such as a conventional microprocessor, is fixedly mounted in the lumen of the housing 12. The control circuitry 50 is adapted for tracking elapsing time, actuating the motor 44, actuating the light emitting means 20, emitting a musical signal to the speaker 20 and sensing relatively loud sounds by way of a conventional sound detecting device such as a microphone 52. The control circuitry 50 is operationally coupled to the female plug 35, the light emitting means 20 and the speaker 22. The control circuitry 50 turns on the motor, speaker and light emitting means for a specified amount of time. The specified amount of time generally is between 10 minutes and 20 minutes. The control. circuitry 50 actuates the motor, light emitting means and the speaker when a loud noise is detected and turns such off when the specified amount of time has elapsed.

A power supply 54 is removably mounted in the lumen. The power supply 54 is operationally coupled to the control circuitry 50 and preferably comprises at least on battery, not shown. The battery is positioned generally adjacent to the door 18 so that the door 18 may be removed to replace and insert batteries.

An actuating means 56 turns the control circuitry 50 on and off. The actuating means 56 is mounted in the top wall of the housing 12 and operationally coupled to the control circuitry 50. The actuating means 56 may also have an automatic setting 57. In this setting, the control circuitry 56 will only actuate the speaker, motor and light if a sound is detected, while the "on" selection will cause the control circuitry 56 to continuously activate the speaker 22, light 20 and motor 44.

A coupling means couples the housing to a crib or other similar structure. The coupling means includes a lip 58 integrally coupled to and extending away from the back wall 13 of the housing 12. The lip 58 generally defines a peripheral wall around the light emitting means 20. The lip 58 has a top'surface 59 having a pair of detents 60 therein.

A neck portion 62 is integrally coupled to and extends away from the door 18, though it may extend from the back wall 13 as well. The neck portion 62 has a well 63 extending therein. The neck portion 62 is spaced from the lip 58. A longitudinal axis of the first portion 31 of the arm portion 24 extends through the neck portion 62 and the lip 58.

A cover portion 64 comprises a plate 66 having a front side 67 and a back side 68. The back side 68 of the plate has a protruding member 69 thereon. The protruding member 69 is adapted for extending into the well 63 and removably coupling to the neck portion 62. The plate 66 has a peripheral wall 70 having an inner surface. A pair of nubs 71 is integrally coupled to the inner surface. Each of the nubs 71 is positioned to releasably engage one of the detents 60 when the protruding member 69 extends into the neck portion 62. The plate 66 has a window 72 therein. The window 72 is positioned to correspond with the light emitting means 20.

In use, the device 10 is mounted on the crib by placing the railing 74 between the lip 58 and the neck portion 62. The cover portion 64 is them placed over and coupled to the lip 58 and neck portion 62 to hold the device 10 on the railing 74. The device 10 can be used without the mobile 48 by removing the second portion 32 of the arm 24 so that only the light 20 and speaker 22 are used. The device 10 will activate when the child makes a loud-sound. This prevents the need for the parent to. activate the device. -The control circuitry 50 may be programmed for any number of musical sounds to be sent to the speaker 22.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A voice activated mobile device, said device being removably attachable to a crib, said device comprising: a housing;

an arm portion, said arm portion being elongate and having a first end and second end, said first end being securely attached to said housing, said arm extending upwardly away from said housing, said arm being arced;

a casing, said casing being integrally coupled to said second end of said arm portion, a bottom side of said casing having a hole therethrough;

a motor, said motor being mounted in said casing, a rod being securely attached to said motor and extending through said hole in said casing, said rod being rotatable by said motor;

a mobile, said mobile being coupled to a free end of said rod;

control circuitry, said control circuitry being fixedly mounted in said housing and being operationally coupled to said motor, said control circuitry being adapted for tracking elapsing time, actuating said motor, and sensing relatively loud sounds, wherein said control circuitry turns on said motor for an amount of time when a loud sound is detected;

a power supply being operationally coupled to said control circuitry; and a coupling means for coupling said housing to the crib, said coupling means comprising;

a lip being integrally coupled to and extending away from a back wall of said housing;

a neck portion being integrally coupled to and extending away from said back wall of said housing, said neck portion being spaced and located below said lip when said arm is extending upwardly when said housing is coupled to the crib; and a cover portion being removably attachable to said lip and said neck;

a light emitting means for emitting a light, said light emitting means being mounted on said housing; and said control circuitry being adapted for actuating said light emitting means, said control circuitry being operationally coupled to said light emitting means;

said lip defines a peripheral wall around said light emitting means, said cover portion comprising a plate having a front side and a back side, said back side of said plate having a protruding member thereon, said protruding member being extendable into and removably couplable to said neck portion, said plate having a window therein, said window being positioned to correspond with said light emitting means.

2. The voice activated mobile device as in claim 1, further comprising:

a speaker for emitting sound, said speaker being securely mounted in said housing; and said control circuitry being adapted to emit a musical signal to said speaker, said control circuitry being operationally coupled to said speaker.

3. A voice activated mobile device, said device being removably attachable to a crib, said device comprising:

a housing;

an arm portion, said arm portion being elongate and having a first end and second end, said first end being securely attached to said housing, said arm extending upwardly away from said housing, said arm being arced, said arm having a break therein such that a first portion and second portion is defined, said break being generally nearer said first end than said second end of said arm portion, said first portion being removably coupled to said second portion such that an end of said second portion is extendable into an end of said first portion, said end of said second portion having a male plug attached thereto, said end of said first portion having a female plug attached thereto;

a casing, said casing being integrally coupled to said second end of said arm portion, a bottom side of said casing having a hole therethrough;

a motor, said motor being mounted in said casing, a rod being securely attached to said motor and extending through said hole in said casing, said rod being rotatable by said motor;

a mobile, said mobile being coupled to a free end of said rod;

a light emitting means for emitting a light, said light emitting means being mounted on said housing;

a speaker for emitting sound, said speaker being securely mounted in said housing;

control circuitry, said control circuitry being fixedly mounted in said housing, said control circuitry being operationally coupled to said speaker, light emitting means and said motor, said control circuitry being adapted for tracking elapsing time, sensing relatively loud sounds, emit a musical signal to said speaker, and actuating said motor and light emitting means, wherein said control circuitry turns on said motor, light emitting means and said speaker for an amount of time when a relatively loud sound is detected, said control circuitry being operationally coupled to said female plug; and a coupling means for coupling said housing to the crib.

4. The voice activated mobile device as in claim 3, wherein said coupling means comprises:

a lip, said lip being integrally coupled to and extending away from a back wall of said housing, said lip generally defining a peripheral wall around said light emitting means, said lip having a top surface having a pair of detents therein;

a neck portion, said neck portion being integrally coupled to and extending away from said back wall of said housing, said neck portion having a well extending therein, said neck portion being spaced from said lip; and a cover portion, said cover portion comprising a plate having a front side and a back side, said back side of said plate having a protruding member thereon, said protruding member being extendable into and removably couplable to said neck portion, said plate having a peripheral wall having an inner surface, a pair of nubs being integrally coupled to said inner surface, each, of said nubs being positioned to releasably engage one of said detents when said protruding member extends into said neck portion, said plate having a window therein, said window being positioned to correspond with said light emitting means.

5. A voice activated mobile device, said device being removably attachable to a crib, said device comprising:

a housing, said housing having a back wall, a front wall, a top wall, a bottom wall and a pair of side walls, said back wall having a door therein, said door being selectively removable from said back wall, said back wall having a plurality of apertures therein positioned generally adjacent to one of said side walls;

a light emitting means for emitting a light, said light emitting means being mounted on said back wall, said light emitting means comprising a light bulb;

a speaker for emitting sound, said speaker being securely mounted in said housing and positioned generally adjacent to said apertures in said back wall;

an arm portion, said arm portion being elongate and having a first end and second end, said first end being securely attached to said housing, said arm extending upwardly away from said housing, said arm being arced, said arm having a break therein such that a first portion and second portion is defined, said break being generally nearer said first end than said second end of said arm portion, said first portion being removably coupled to said second portion such that an end of said second portion is extendable into an end of said first portion, said end of said second portion having a male plug attached thereto, said end of said first portion having a female plug attached thereto;

a casing, said casing having a top side, a bottom side and a peripheral wall extending therebetween, said peripheral wall being integrally coupled to said second end of said arm portion, said bottom side having a hole therethrough;

a motor, said motor being mounted in said casing, a rod being securely attached to said motor and extending through said hole in said casing, said rod being rotatable by said motor, said motor being operationally coupled to said male plug;

a mobile, said mobile being coupled to a free end of said rod;

control circuitry, said control circuitry being fixedly mounted in said housing, said control circuitry being adapted for tracking elapsing time, actuating said motor, actuating said light emitting means, emitting a musical signal to said speaker and sensing relatively loud sounds, said control circuitry being operationally coupled to said female plug, said light emitting means and said speaker, wherein said control circuitry turns on said motor, speaker and light emitting means for an amount of time, said amount of time generally being between 10 minutes and 20 minutes, wherein said control circuitry actuates said motor, light emitting means and said speaker when a loud noise is detected and turns such off when said specified amount of time has elapsed;

a power supply being operationally coupled to said control circuitry an actuating means for turning said control circuitry on and off, said actuating means being mounted on said top wall of said housing and operationally coupled to said control circuitry, a coupling means for coupling said housing to the crib, said coupling means comprising:

a lip, said lip being integrally coupled to and extending away from said back wall of said housing, said lip generally defining a peripheral wall around said light emitting means, said lip having a top surface having a pair of detents therein;

a neck portion, said neck portion being integrally coupled to and extending away from said door, said neck portion having a well extending therein, said neck portion being spaced from said lip, a longitudinal axis of said first portion of said arm portion extending through said neck portion and said lip; and a cover portion, said cover portion comprising a plate having a front side and a back side, said back side of said plate having a protruding member thereon, said protruding member being extendable into and removably couplable to said neck portion, said plate having a peripheral wall having an inner surface, a pair of nubs being integrally coupled to said inner surface, each of said nubs being positioned to releasably engage one of said detents when said protruding member extends into said neck portion, said plate having a window therein, said window being positioned to correspond with said light emitting means.

* * * * *